US008689763B2

(12) United States Patent
Pandolfo

(10) Patent No.: US 8,689,763 B2
(45) Date of Patent: Apr. 8, 2014

(54) ROTARY ENGINE WITH A CIRCULAR ROTOR

(76) Inventor: Henri Pandolfo, Antibes (FR)

( * ) Notice: Subject to any disclaimer, the term of this patent is extended or adjusted under 35 U.S.C. 154(b) by 335 days.

(21) Appl. No.: 13/147,058

(22) PCT Filed: Sep. 18, 2009

(86) PCT No.: PCT/FR2009/001104

§ 371 (c)(1),
(2), (4) Date: Oct. 20, 2011

(87) PCT Pub. No.: WO2010/086516

PCT Pub. Date: Aug. 5, 2010

(65) Prior Publication Data

US 2012/0023917 A1 Feb. 2, 2012

(30) Foreign Application Priority Data

Jan. 30, 2009 (FR) ..... 09 00392

(51) Int. Cl.
*F01C 1/00* (2006.01)

(52) U.S. Cl.
USPC ..... 123/200; 123/248; 123/249; 418/195; 418/207; 418/226

(58) Field of Classification Search
USPC ..... 60/325; 418/160, 161, 164; 123/200, 123/204, 205, 208, 210, 228.241, 43 R
See application file for complete search history.

(56) References Cited

U.S. PATENT DOCUMENTS

| | | | | |
|---|---|---|---|---|
| 3,739,754 | A * | 6/1973 | Nutku | 123/229 |
| 5,131,359 | A * | 7/1992 | Gomm et al. | 123/248 |
| 6,119,649 | A * | 9/2000 | Raab | 123/233 |
| 6,276,329 | B1 * | 8/2001 | Archer | 123/228 |
| 2005/0045841 | A1 * | 3/2005 | Hartman | 251/129.11 |
| 2008/0050258 | A1 * | 2/2008 | Wright | 418/33 |
| 2010/0095926 | A1 * | 4/2010 | Wright | 123/210 |

FOREIGN PATENT DOCUMENTS

| | | | | |
|---|---|---|---|---|
| DE | 339 761 | C | 8/1921 | |
| DE | 11 14 825 | B | 10/1961 | |
| DE | 1553050 | A1 * | 2/1966 | F01C 3/00 |
| DE | 2304333 | A * | 8/1974 | F01C 3/06 |
| DE | 31 46 782 | A1 | 6/1983 | |

OTHER PUBLICATIONS

International Search Report, dated Jul. 29, 2010, from corresponding PCT application.

* cited by examiner

*Primary Examiner* — Kenneth Bomberg
*Assistant Examiner* — Jason T Newton
(74) *Attorney, Agent, or Firm* — Young & Thompson

(57) ABSTRACT

The rotary engine includes a circular stator, a circular rotor rotating about the stator; the rotor and the stator being separated by a circular cylinder and at least one element with two flanges. The rotor includes two compression pistons attached to the inner surface of the rotor. These two pistons are located at the two extremities of a first diameter of the rotor and kept substantially in contact with the outer surface of the stator. The stator includes a recess at each extremity of a diameter. Each recess forms a compression chamber with the compression piston positioned at the end of the recess in the direction of rotation of the rotor and one of the flanges of the element with two flanges, referred to as the cylinder head flange. The motive force is applied to the compression piston when the pressure of the gases inside the compression chamber is suddenly increased to a predefined value.

15 Claims, 6 Drawing Sheets

ROTARY ENGINE WITH A CIRCULAR ROTOR

TECHNICAL FIELD

The present invention relates to gasoline or compressed air rotary engines based on the rotational motion of a rotor, and relates particularly to a rotary engine with a circular rotor.

STATE OF THE ART

Vehicle engines currently in use are internal combustion engines comprising reciprocating pistons in which the motive force is produced by the explosion of a mixture of air and fuel such as gasoline. Each piston, housed in a cylinder, is pushed away violently by the explosion and causes a crankshaft to rotate via a connecting rod. However, these engines have a major drawback in that the stroke of the piston in the cylinder is limited to about eight cm. The lever arm of the crankshaft is therefore limited to about four cm, and therefore all the motive force occurs on these four cm of the lever arm, significantly limiting the engine torque.

The use of rotary engines has thus been considered in place of reciprocating engines. The operation of rotary engines is slightly more complex than that of traditional piston engine. Unlike an internal combustion engine, which operates thanks to pistons, rotary engines use a rotor. Unlike internal combustion engines, rotary engines comprise neither connecting rods nor crankshaft.

There are advantages to using rotary engines rather than reciprocating engines. First, because this engine has no reciprocating parts, it is very well balanced; this ensures its vibration-free operation, thus limiting the noise level regardless of engine speed. Secondly, this engine causes less vibration, since all the parts follow the same path as they all rotate in the same direction. In addition, since there are fewer moving parts in the engine, the rotary engine is more reliable.

A known engine of this type comprises a rotor that performs an oval-shaped orbital movement inside a housing. The main element of this engine, the rotor, is a triangular object positioned right in the center of the engine. This rotor performs an almost oval orbit within the housing, which is called a "stator". With each rotation, the extremities of the rotor are always in contact with the stator. These contacts therefore form the compression chambers, namely three in all. There is a crank in the center of this rotor, which consists of two toothed gears: one large and one small. The larger gear thus mates with the smaller one to define the path of the rotor in the housing.

But this type of rotary engine presents a number of drawbacks. For example, the number of revolutions per minute must be much higher than in a conventional engine. For example, to obtain optimum power, about 8500 RPM must be reached. This has the disadvantage of not producing very high torque at low engine speed. Under 5000 RPM, nothing happens, no torque is discernible. The disadvantage of this high speed is that the oil used as a lubricant will burn. It is not possible to remove the oil without encountering sealing problems. Finally, another drawback is fuel consumption which is at least 20% higher than reciprocating engines of equal power.

It is therefore better to use a rotary engine whose rotor is circular and rotates around the stator, as in the case of the engine described in document DE 3146782. But this engine does not comprise a compression chamber with an adequate seal.

BRIEF DESCRIPTION OF THE INVENTION

Therefore the aim of the invention is to provide a rotary engine with circular rotor rotating around a stator which has a perfect seal and does not require the use of lubricants.

Another aim of the invention is to provide a rotary engine with circular rotor rotating around a stator which allows engine torque to be relative to the diameter of the rotor and much higher than that of existing engines.

The subject of the invention is therefore a rotary engine comprising a circular stator, a circular rotor rotating about the stator; the rotor and the stator are separated by a circular cylinder and at least one element with two flanges. The rotor comprises two compression pistons attached to the inner surface of the rotor; these two pistons are located at the two extremities of a first diameter of the rotor and kept substantially in contact with the outer surface of the stator. The stator comprises a recess at each extremity of a diameter; each recess forms a compression chamber with the compression piston positioned at the end of the recess in the direction of rotation of the rotor and one of the flanges of the element with two flanges, referred to as the cylinder head flange; the motive force is applied to the compression piston when the pressure of the gases inside the compression chamber is suddenly increased to a predefined value.

According to a first embodiment, the engine according to the invention is used as an internal combustion engine in which each of the recesses comprises a gasoline inlet line and a spark plug; the gasoline is injected into the compression chamber by the fuel inlet line when the compression piston is in front of the recess and the transit and cylinder head flanges of the flanged element are closed, and the spark plug is activated when the compression piston is at the end of the compression chamber, with the transit flange open, such that the explosion of the fuel and gasoline mixture in the compression chamber produces the motive force on the compression piston.

In a second embodiment, the motor according to the invention is used as a compressed air motor. In this case, each of the recesses comprises a compressed air inlet line, compressed air is injected into the compression chamber associated with each recess when the compression piston arrives at the end of the compression chamber, with the transit flange open, so as to produce the same motive force as the explosion of the air-gasoline mixture of the same internal combustion engine.

BRIEF DESCRIPTION OF THE FIGURES

The aims, subjects and characteristics of the invention will become clearer on reading the following description with reference to the drawings, in which.

DETAILED DESCRIPTION OF THE INVENTION

Figure 1A:
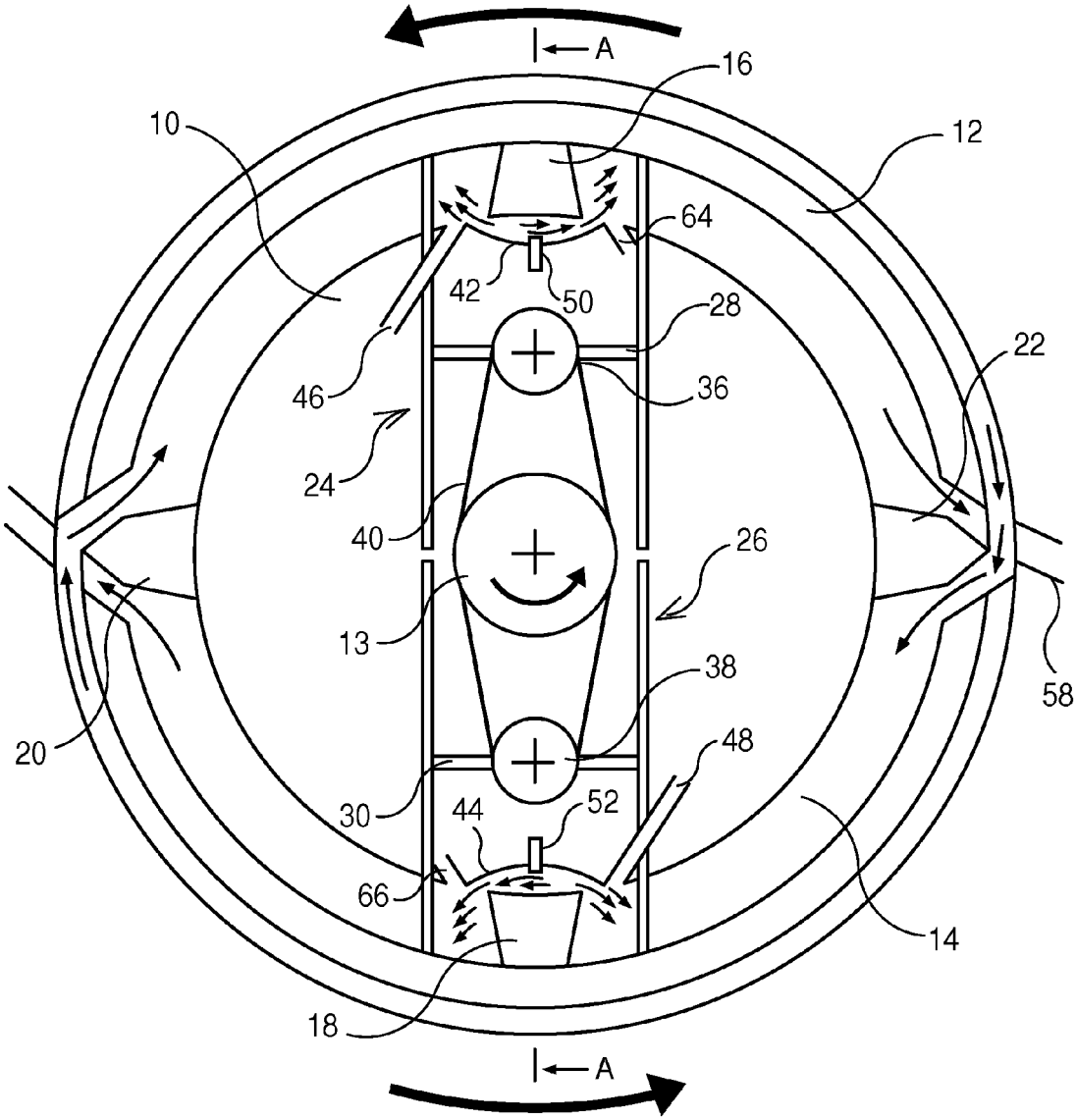
FIGS. 1A, 1B, 1C and 1D are cross-section views of the engine showing each of the engine's components for four successive positions of the engine after it has turned 90° anticlockwise from each position in relation to the previous position.

The rotary engine according to a preferred embodiment of the invention, in which the engine is an internal combustion engine shown in FIGS. 1A, 1B, 1C and 1D, comprises a stator 10 around which a rotor 12 turns. The rotor 12 is driven in anticlockwise rotation around a shaft 13. The stator and rotor are separated by a space that constitutes the cylinder. The engine comprises four pistons fixed to the inner surface of the rotor 12: two compression pistons 16 and 18 located at the two extremities of a rotor diameter and two intake/exhaust pistons 20 and 22 located at the two extremities of a diameter perpendicular to the previous one and therefore at a 90° angle to the two compression pistons.

Figure 2:
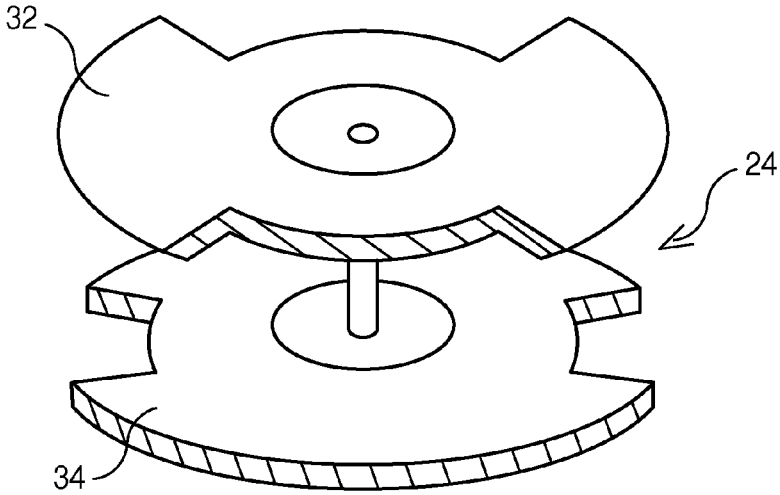
FIG. 2 is a perspective view of the element with two flanges.

At the same time that the rotor is driven in rotation about its shaft, two identical flanged elements 24 and 26 are also driven in rotation about their respective shafts 28 and 30. Each flanged element comprises two flanges. Thus, the flanged element 24 shown in FIG. 2 comprises a transit flange 32 and a cylinder head flange 34 connected by a rotational drive mechanism. The transit flange 32 allows the passage of the gases in cylinder 14 to the rear of the piston.

The two flanged elements 24 and 26, seen in cross-section in FIGS. 1A to 1D, are driven in rotation by the rotation of the rotor. The shaft 13 of the rotor 12 in rotary motion drives the shaft 36 associated with the flanged element 24 and the shaft 38 associated with the flanged element 26 by means of a belt 40. Each of the shafts 36 and 38 drives respectively each of the shafts 28 and 30 of the associated flanged elements thanks to a bevel gear device, not shown in FIG. 2, which consists of two gears at a 45° angle to their axis, thus transforming a rotary motion around the shaft 36 or 38 into a rotary motion around the perpendicular shaft 28 or 30 respectively.

The stator 10 comprises two recesses 42 and 44 located at the two extremities of a diameter. Each of these two recesses comprises a gasoline inlet line, the line 46 for recess 42 and the line 48 for recess 44, as well as a spark plug 50 for recess 42 and a spark plug 52 for recess 44.

When the engine is in the position shown in FIG. 1A, the two flanges of the flanged element 24 form a closed compression chamber 54 in which the compression piston 16 is located. The gasoline inlet through the line 46 is activated and the air-gasoline mixture is formed in the chamber thus formed.

Figure 3A:
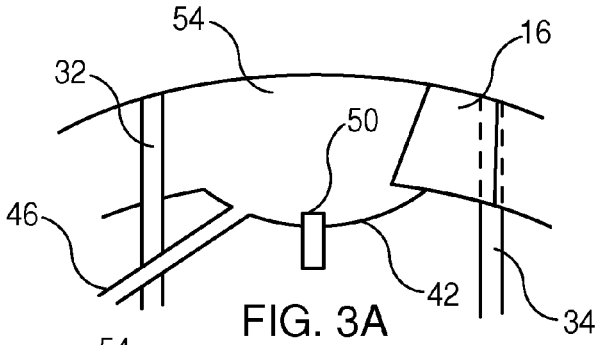
FIGS. 3A, 3B and 3C are cross-section views showing the progression of the compression piston in the compression chamber from its entry into the chamber until the moment of explosion of the air-gasoline mixture.
Figure 3B:
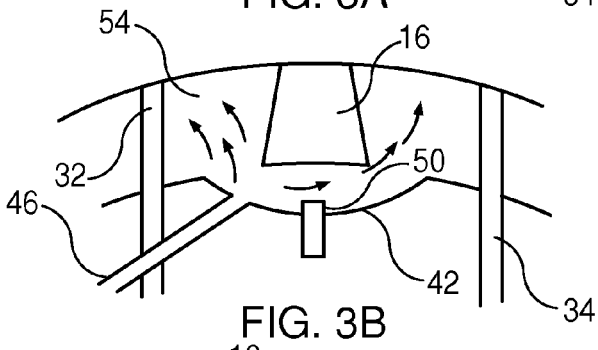
Figure 3C:
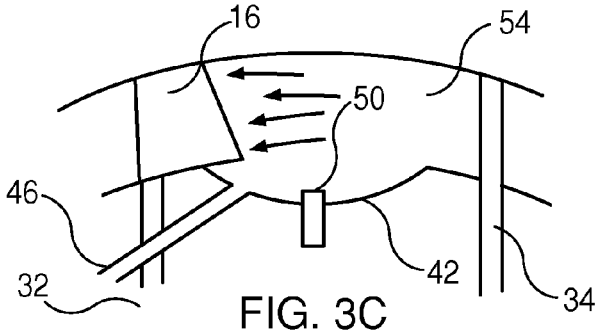

The phase leading to the explosion is explained with reference to FIGS. 3A, 3B and 3C. In FIG. 3A, the compression piston 16 reaches the beginning of the chamber 54. Thanks to the opening of the cylinder head flange 34 while the transit flange is closed, the air in the chamber 54 begins to be compressed. Then, when the piston 16 reaches the middle of the chamber 54, i.e. opposite the recess 42, the two flanges 32 and 34 are closed and the gasoline is injected into the chamber through the inlet line 46 as shown in FIG. 3B. Finally, when the piston 16 reaches the end of the chamber, the transit flange 32 is in its open portion and the spark plug 50 is activated so as to cause the explosion in the chamber 54 as shown in FIG. 3C. This explosion allows a motive force to be exerted on the piston 16 and thus to drive the rotor in rotation.

Figure 1B:
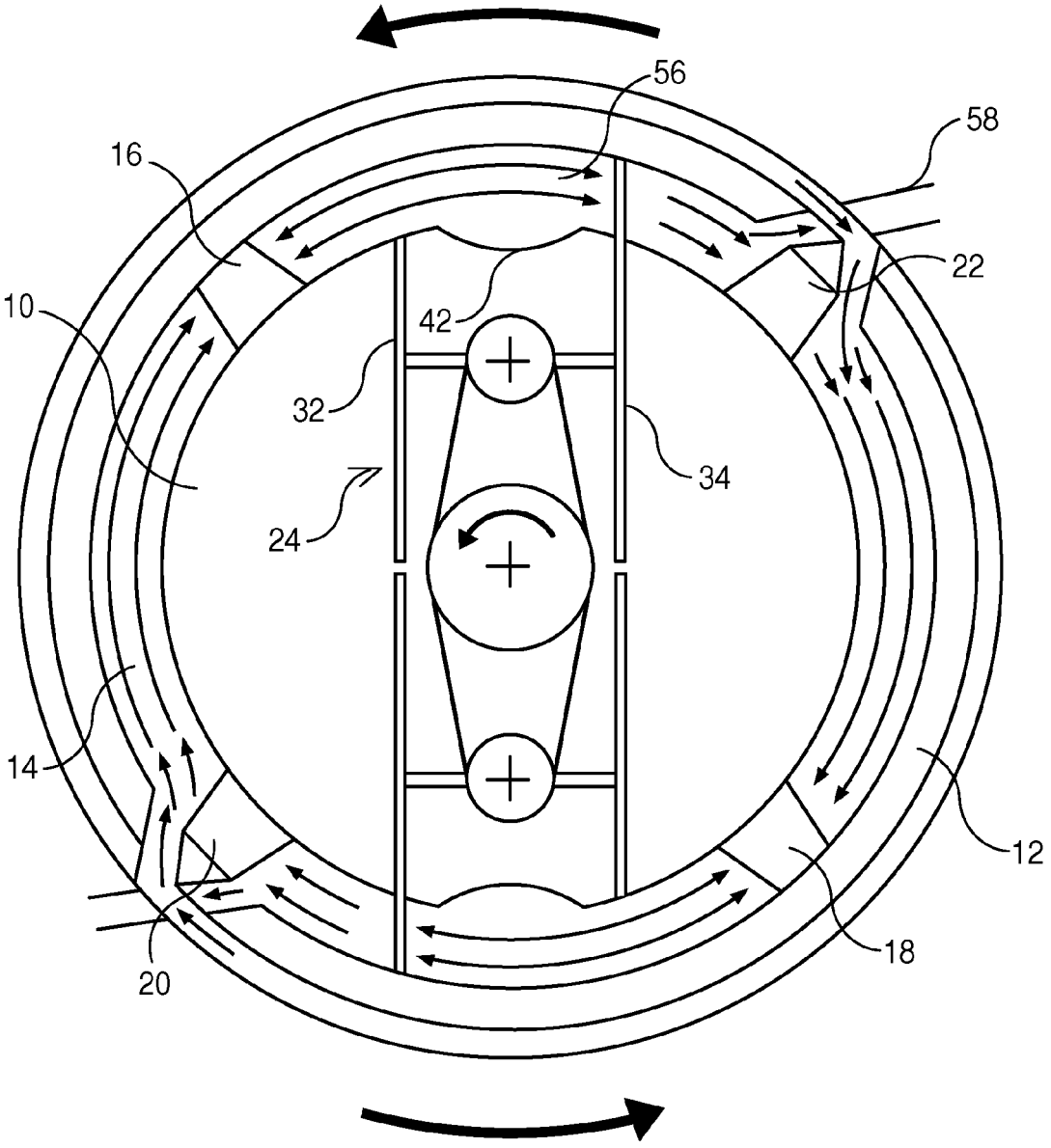

When the engine is in the position shown in FIG. 1B, the compression piston 16 has performed a 45° rotation thanks to the expansion of the air-gasoline volume 56 that has exploded and is blocked by the closing of the cylinder head flange 34 of the flanged element 24. Air enters the cylinder 14 thanks to a turbocharger (not shown).

Note that the exhaust of the gases burned in the preceding explosion takes place at the front of the intake/exhaust piston 22 through an exhaust port 58. When the engine reaches the position shown in FIG. 1B, the volume of exhaust gas in the cylinder is reduced because the piston 22 moves forward so that this part of the cylinder is blocked by the cylinder head flange 34.

Figure 1C:
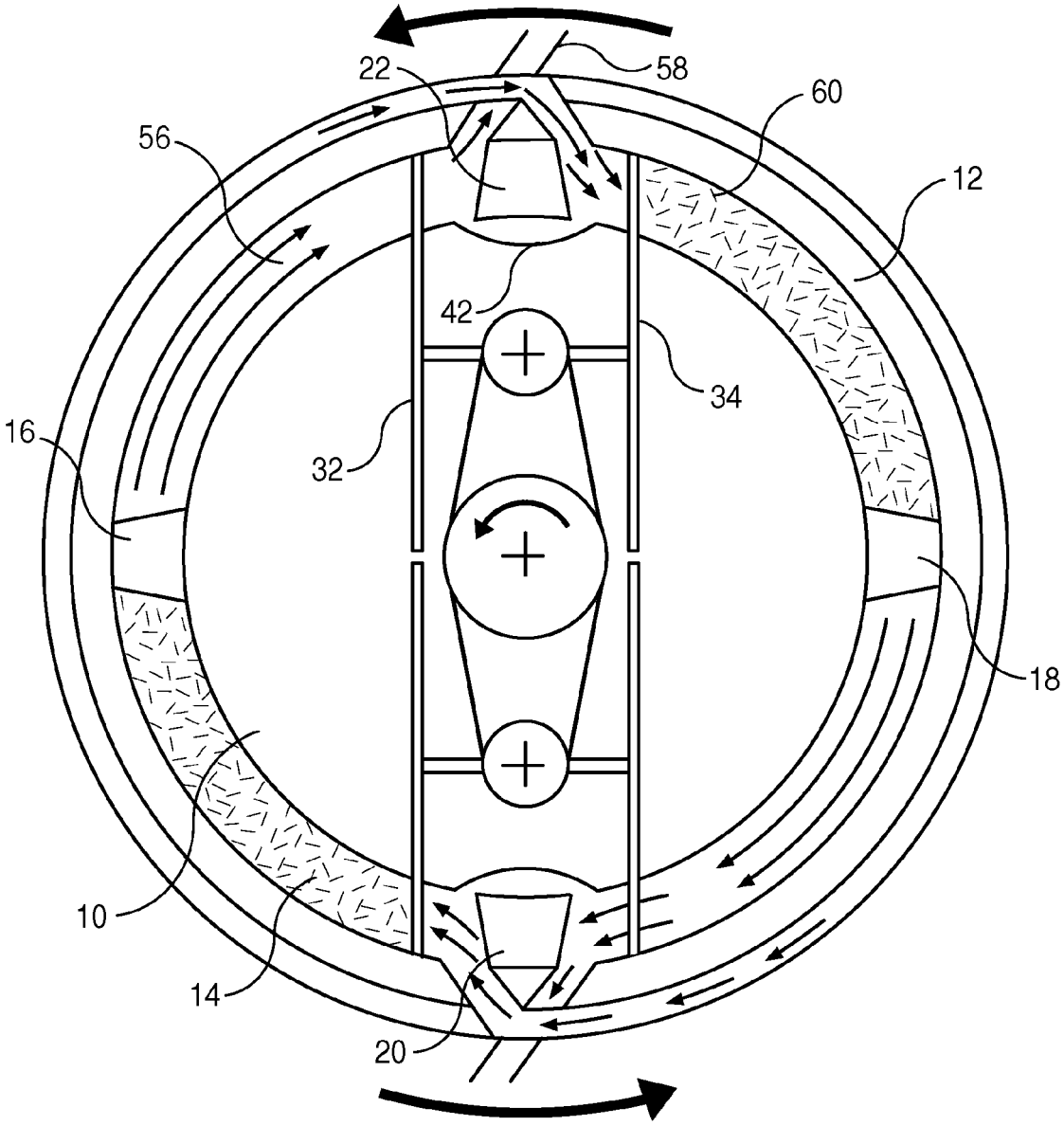

When the engine is in the position shown in FIG. 1C, the compression piston 16 has performed a 180° rotation since the explosion. The intake/exhaust piston 22 is then opposite the recess 42 of the stator. The volume 56 of burnt gases is at its maximum expansion and the burnt gases begin to escape through the exhaust port 58. The air that entered the cylinder then occupies the portion 60 that is its maximum volume between the compression piston 18 and the closed cylinder head flange 34.

Figure 1D:
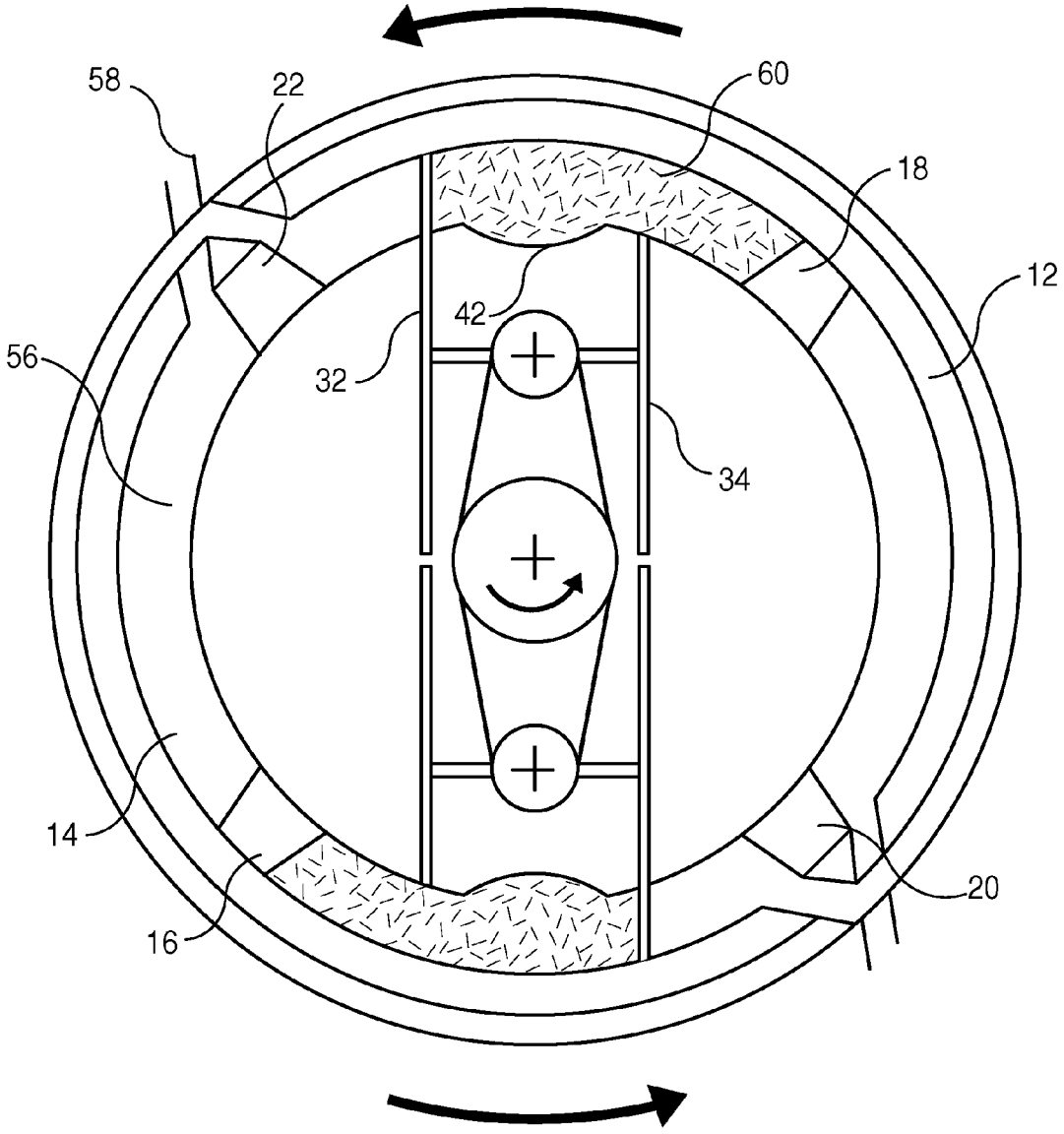

When the engine is in the position shown in FIG. 1D, the compression piston 16 has already completed ¾ of a turn. The air in the portion 56 continues to escape through the exhaust port 58. The volume of the portion 60 of the cylinder begins to be compressed because it is trapped between the transit flange 32 (cylinder head flange open) and the intake/exhaust piston 18.

Then, when the piston 18 reaches the top of the recess 42, it has taken the place of piston 16 as shown in FIG. 1A. Therefore, the phases described with reference to FIGS. 1A, 1B, 1C and 1D are reproduced in the same way, the pistons 16 being replaced by the pistons 18 and 20, respectively.

Note that the phases just described with the pistons 16 and 22 are performed in the same way and at the same time with the pistons 18 and 20. This means that the air and gasoline intake in the two diametrically opposed chambers takes place at the same time and that the spark plugs are activated at the same time in the two chambers. It is therefore unnecessary to describe them.

Thus it can be seen that at each half-turn of the rotor 12, two explosions take place at the same time due to the compression pistons 16 and 18. Therefore, there are four explosions at every revolution of the rotor, which is equivalent to two times a complete four-stroke cycle, compared to the reciprocating internal combustion engine that performs a four-stroke cycle in two revolutions of the engine.

Figure 4:
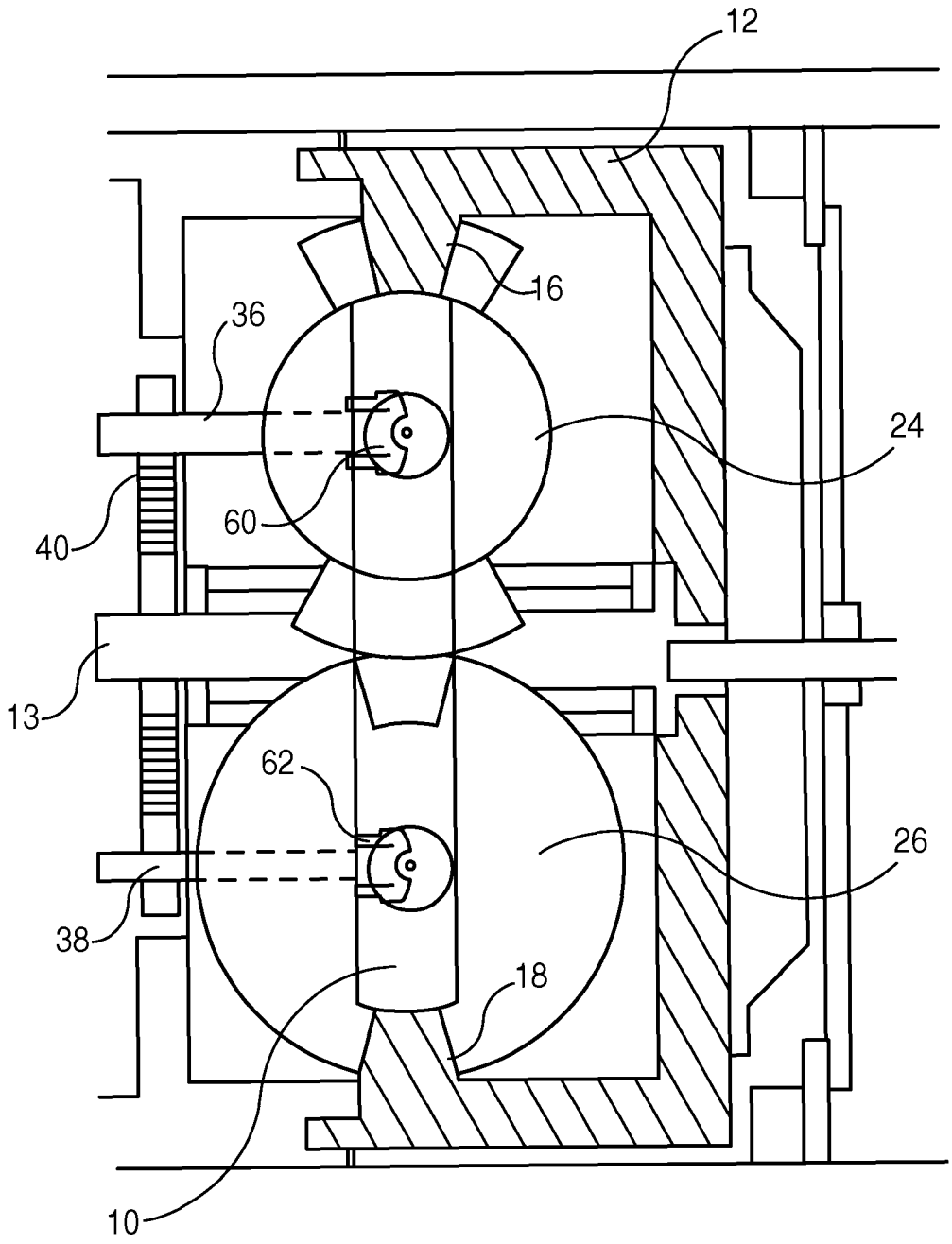
FIG. 4 is a cross-section view of the engine, perpendicular to the cross-section of FIG. 1A; it shows the rotor surrounding the stator and the two flanged elements, as well as these elements being driven by a belt from the rotor shaft.

In FIG. 4, which shows the engine along a cross-section A-A of FIG. 1A, the transit flange of the flanged element 24 and the cylinder head flange of the flanged element 26 can be seen. Note that the two flanged elements 24 and 26 are offset by 180°, the transit flange of one of them is in alignment with the other's cylinder head flange and vice versa.

As shown in FIG. 4, the rotor 12 that comprises the two compression pistons 16 and 18 rotates around the stator 10. The rotor rotates about the shaft 13 and the two flanged elements 24 and 26 rotate about their respective shafts 28 and 30. These last are driven in rotation through the rotary motion of the rotor 12 about its shaft 13 which drives two primary shafts 36 and 38 in rotation by means of the belt 40. The shafts 36 and 38 communicate the rotation respectively to the shafts 28 and 30 by means of bevel gear devices 60 and 62.

Note that the diameter of the shafts 36 and 38 is equal to half the diameter of the shaft 13. Thus, since the shafts 36 and 38 are driven by the belt 40, their speed of rotation is twice that of the rotor 12. It would be possible to make the flanged elements rotate at the same speed as the rotor. However this would require having four openings in each flange instead of two as is the case in the embodiment described hereabove. There could even be a single flanged element rotating at the same speed as the rotor. However the diameter of the flanged element would have to be at least double, which would increase the bulk.

The torque of the engine just described is a function of the rotor's diameter. Thus, the diameter of the rotor can be 40 cm, which allows torque five times greater than the torque of a reciprocating engine with a piston stroke of eight cm to be achieved.

As for sealing, the rotary engine just described comprises a spring (not shown) located on the back of each piston that keeps the piston in contact with the surface of the stator. As the speed increases after the engine has been started, the springs are compressed due to the centrifugal force and the pistons move slightly away from the surface of the stator. When the optimum speed is reached, this speed is such that there is a seal caused by the speed with no need for contact. When the engine stops, the pistons retract to come in contact with the surface of the stator and realize the seal at startup. Since there is no friction on the rotor as it turns, it is not necessary to use lubricant.

As regards cooling, it is performed by air from the rotating rotor. A ventilation device to the rear of the engine (not shown) forces air to move inside the engine so as to cool all the rotating parts.

Although the preferred embodiment is a rotary internal combustion engine, it is possible to operate the engine with compressed air. To achieve this, a compressed air inlet line is provided for each recess of the stator, the line 64 for the recess 42 and the line 66 for the recess 44. A simple switch is sufficient to remove the fuel injection by the gasoline inlet lines 46 and 48 and to open the compressed air inlet lines 64 and 66. The compressed air pressure is about 30 bar which corresponds to the gas pressure in the chamber after explosion. As shown in FIG. 1A, the compressed air is injected into the compression chamber when the compression piston arrives at the end of the compression chamber, with the transit flange open and produces the same motive force as the explosion of the air-gasoline mixture of the same internal combustion engine.

Note that the embodiment using compressed air has a major advantage over current engines using an explosive fuel/air mixture in that there is no release of carbon dioxide and therefore zero pollution. This is a considerable advantage in the current fight against carbon emissions.

Note that it is possible to build a system combining several engines according to the invention. For example, a system using a combination of two engines can be envisaged. Such a system would comprise a single rotor rotating about two stators. In this case, four compression pistons would produce the motive force for each turn of the common rotor, i.e. eight explosions for an internal combustion engine.

In summary, all the following combinations can be considered in the case of an internal combustion engine:

two explosions per revolution compared to a four-cylinder reciprocating engine, four explosions per revolution compared to an eight-cylinder reciprocating engine, eight explosions per revolution compared to a sixteen-cylinder reciprocating engine, sixteen explosions per revolution compared to a thirty-two-cylinder reciprocating engine.

The invention claimed is:

1. Rotary engine comprising a circular stator, a circular rotor rotating about the stator; the rotor and the stator are separated by a circular cylinder and at least one element with two flanges, wherein:

said rotor comprises two compression pistons attached to the inner surface of the rotor; these two pistons are located at the two extremities of a first diameter of the rotor and kept substantially in contact with the outer surface of the stator and said stator comprises a recess at each extremity of a diameter; each recess forms a compression chamber with said compression piston positioned at the end of the recess in the direction of rotation of the rotor and one of the flanges of said element with two flanges, referred to as the cylinder head flange; the motive force is applied to said compression piston when the pressure of the gases inside said compression chamber is suddenly increased to a predefined value.

2. Engine according to claim 1, wherein said rotor comprises two intake/exhaust pistons attached to the inner surface of the rotor and located at the two extremities of a second diameter of the rotor perpendicular to said first diameter and maintained substantially in contact with the outer surface of the stator, said pistons being used in the intake of the gases into said cylinder and their exhaust, and said element with two flanges comprises a transit flange in front of the cylinder head flange in the direction of rotation of the rotor used for the transit of gases within said cylinder.

3. Engine according to claim 2, comprising two flanged elements driven in rotation by the rotation of the rotor; said rotor's shaft drives primary shafts through a belt; each of said primary shafts driving respectively each of the shafts of the associated flanged element thanks to a bevel gear device thus allowing a rotary motion around each of said primary shafts to be converted into a rotary motion around the shaft perpendicular to each of said flanged elements respectively.

4. Engine according to claim 3, wherein the diameter of said primary shafts is equal to half the diameter of the shaft of said rotor, such that the rotational speed of said flanged elements is twice the speed of rotation of said rotor.

5. Engine according to claim 4, wherein a spring is located on the back of each of said compression and intake/exhaust pistons to maintain each of said pistons in contact with the surface of said stator when starting the engine, said springs are compressed by the centrifugal force as the speed increases after the engine has been started such that said pistons move slightly away from the surface of the stator, thus avoiding all friction on the outer surface of said stator.

6. Engine according to claim 5, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

7. Engine according to claim 4, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

8. Engine according to claim 3, wherein a spring is located on the back of each of said compression and intake/exhaust pistons to maintain each of said pistons in contact with the surface of said stator when starting the engine, said springs are compressed by the centrifugal force as the speed increases after the engine has been started such that said pistons move slightly away from the surface of the stator, thus avoiding all friction on the outer surface of said stator.

9. Engine according to claim 3, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

10. Engine according to claim 2, wherein a spring is located on the back of each of said compression and intake/exhaust pistons to maintain each of said pistons in contact with the surface of said stator when starting the engine, said springs are compressed by the centrifugal force as the speed increases after the engine has been started such that said pistons move slightly away from the surface of the stator, thus avoiding all friction on the outer surface of said stator.

11. Engine according to claim 2, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

12. Engine according to claim 1, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

13. Engine according to claim 1, used as an internal combustion engine, in which each of said recesses comprises a gasoline inlet line and a spark plug, the gasoline is injected into the compression chamber by said fuel inlet line when said compression piston is opposite said recess and said transit and cylinder head flanges of said flanged element are closed, and said spark plug is activated when said compression piston is at the end of said compression chamber, with said transit flange open, such that the explosion of the fuel and gasoline mixture in said compression chamber produces the motive force on said compression piston.

14. Engine according to claim 1, used as a compressed air engine, wherein each of said recesses comprises a compressed air inlet line, the compressed air is injected into the compression chamber associated with each recess when said compression piston reaches the end of said compression chamber, with said transit flange open, so as to produce the same motive force as the explosion of the air-gasoline mixture of the same internal combustion engine.

15. Engine system combining two engines according to claim 1, wherein a single common rotor comprising four compression pistons rotates around two stators to produce four motive forces for every half revolution of said common rotor.

* * * * *

UNITED STATES PATENT AND TRADEMARK OFFICE

CERTIFICATE OF CORRECTION

PATENT NO. : 8,689,763 B2
APPLICATION NO. : 13/147058
DATED : April 8, 2014
INVENTOR(S) : Henri Pandolfo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 415 days.

Signed and Sealed this
Twenty-ninth Day of September, 2015

Michelle K. Lee

Michelle K. Lee
*Director of the United States Patent and Trademark Office*